United States Patent [19]

Hassell

[11] Patent Number: 4,979,647

[45] Date of Patent: Dec. 25, 1990

[54] METHOD AND APPARATUS FOR COOLING AND DISPENSING BEVERAGE

[75] Inventor: David A. Hassell, Anoka, Minn.

[73] Assignee: The Cornelius Company, Anoka, Minn.

[21] Appl. No.: 247,785

[22] Filed: Sep. 22, 1988

Related U.S. Application Data

[63] Continuation of Ser. No. 2,075, Jan. 12, 1987, abandoned, which is a continuation of Ser. No. 621,391, Jun. 18, 1984, abandoned.

[51] Int. Cl.[5] ..... B67D 5/62

[52] U.S. Cl. ..... 222/146.6; 222/129.1; 62/394; 62/399

[58] Field of Search ..... 222/146.6, 129.1, 129.2, 222/129.3, 129.4; 62/394, 399; 248/68.1; 165/172, 162; 47/45

[56] References Cited

U.S. PATENT DOCUMENTS

| | | | |
|---|---|---|---|
| 767,325 | 8/1904 | Beazley | 62/399 |
| 2,103,479 | 12/1937 | Magee | 222/146.6 X |
| 2,986,306 | 5/1961 | Cocanour | 222/129.1 |
| 3,266,672 | 8/1966 | Dean | 222/129.1 |
| 3,809,292 | 5/1974 | Booth et al. | 222/146.6 |
| 3,813,010 | 5/1974 | Hassell et al. | 222/146.6 X |
| 4,175,617 | 11/1979 | Hahn et al. | 165/172 |
| 4,381,764 | 5/1983 | Wojcik | 248/68.1 |

*Primary Examiner*—David H. Bollinger
*Attorney, Agent, or Firm*—Sten Erik Hakanson; Henry C. Kovar

[57] ABSTRACT

A beverage cooling, carbonating and dispensing apparatus has a refrigerator cabinet having a cold air cooling chamber, a cold beverage reservoir and carbonator in the cooling chamber, an outlet from the reservoir to a dispensing valve, and a spring-like helically coiled thermally conductive precooler secured to a beverage inlet of the reservoir, the precooler is suspended in the cold air chamber and has a substantial restriction to flow of beverage therethrough so that the refilling flow into the reservoir is very slow and is cooled to about 40 degrees F. (4.4 degrees C.) before admittance into the reservoir, so the entire contents of the reservoir can be dispensed without warmup or loss of carbonation. A method of cooling, carbonating and dispensing beverage has the steps of storing a supply of previously precooled beverage in a reservoir, dispensing servings of beverage from the reservoir, replenishing the reservoir with new beverage at an incoming flow rate substantially less than the dispensing flow rate by restricting the incoming flow to a trickle and precooling the trickling flow while cooling the reservoir, and carbonating the cold trickling flow upon admittance to the reservoir. This apparatus and method substantially increasing the dispensing capacity.

10 Claims, 3 Drawing Sheets

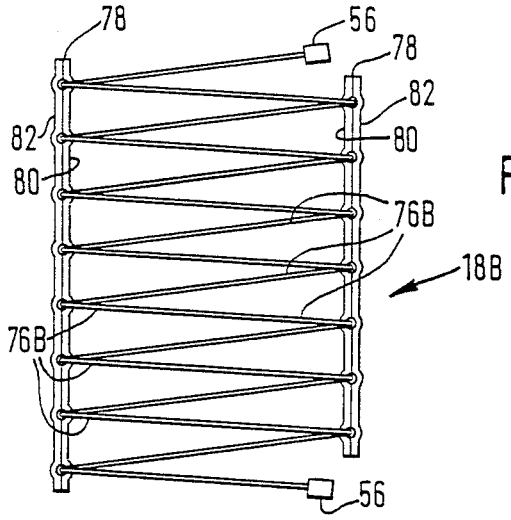
FIG. 8
FIG. 9
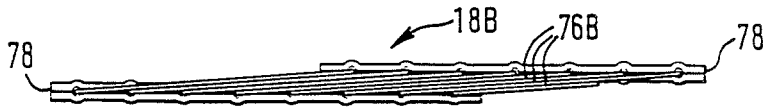
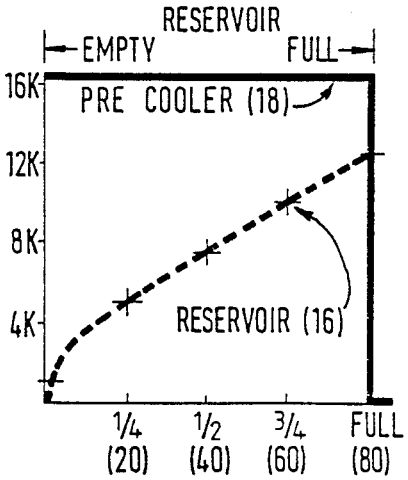
FIG. 10
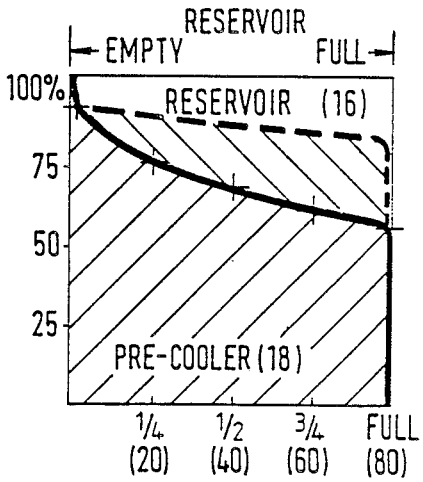
FIG. 11

METHOD AND APPARATUS FOR COOLING AND DISPENSING BEVERAGE

This is a co-pending continuation application based upon U.S. application Ser. No. 002,075 filed Jan. 12, 1987, now abandoned, which was a co-pending continuation application based upon U.S. Ser. No. 621,391 filed June 18, 1984, now abandoned.

BACKGROUND OF THE INVENTION

1. Field of the Invention

This invention pertains to a method of cooling and dispensing beverage, and to apparatus for cooling and dispensing beverage in which the beverage is precooled before admittance into a storage reservoir; the dispensing rate is far greater than the refill rate.

2. The Prior Art

Cold beverages, be they carbonated or non-carbonated, are preferably served at a temperature as close to freezing as is possible. Specifically the preferred serving temperature is as close to 32 degrees F. (0 degrees C.) as is possible. The highest acceptable temperature of dispensed beverage per the standards for the soft drinks of the Coca-Cola Company, the Pepsi-Cola Company, 7-UP Company, Dr. Pepper Company, Royal Crown Cola Company and their many competitors is 40 degrees F. (4.4 degrees C.). A temperature higher than this is considered unsatisfactory.

As the beverage temperature becomes higher, ice is needed in the cup and the beverage then becomes diluted with melting ice water. Off-taste is a problem from melting ice water, foaming and loss of carbonation is a further problem.

Ideally a soft drink should be dispensed at 32 degrees–36 degrees F. (0 degrees–2.2 degrees C.); 40 degrees F. (4.4 degrees C.) is the upper limit of acceptabilty. It is very difficult to attain 32 degrees F. (0 degrees C.) dispensing because this is at the freezing point of water and refrigeration controls and temperature controls are unable to reliably maintain this temperature without occasional freeze-ups. An ice bank type beverage cooler and dispenser can attain dispensing temperature at or close to 32 degrees F. (0 degrees C.) with the use of relatively massive quantities of ice, but an air-cooled or direct refrigerant cooled beverage cooler and dispenser can reliably attain only 36 degrees–40 degrees F. dispensed beverage.

The normal-desired carbonation for cola, lemon-lime, root beer, and most soft drinks other than orange is 3.5 to 4.5 volumes of carbon dioxide gas in the finished drink. Carbonation devices and systems are very sensitive to water or beverage temperatures. For example, at 36 degrees F. (2.2 degrees C.), 18 PSIG (1.27 kg/sq cm) carbon dioxide pressure gives 3.5 volumes of carbonation; at 46 degrees F. (7.8 degrees C.), 25 PSIG (1.76 kg/sq cm) is necessary to obtain 3.5 volumes. In post-mix soft drink dispensing, 5 parts of carbonated water are mixed with 1 part of non-carbonated syrup and the carbonation of the mixed drink ends up being about five-sixths of the carbonation of the water Specifically, if a carbonation of 3.5 volumes is wanted, the carbonated water must have 4.2 volumes. In order to attain 4.2 volumes at 36 degrees F. (2.2 degrees C.), a pressure of 25 PSIG (1.76 kg/sq cm) is required. However, as water warms up the pressure must be increased or the attained carbonation falls off. For example, 25 PSIG (1.76 kg/sq cm) at 42 degrees F. (5.6 degrees C.) gives 3.8 volumes which dilutes to 3.1 volumes in the finished drink, and 25 PSIG (1.76 kg/sq cm) at 48 degrees F. (8.9 degrees C.) gives 3.4 volumes which dilutes to 2.8 volumes in the finished drink, 25 PSIG (1.76 kg/sq cm) at 54 degrees F. (12.2 degrees C.) gives 3.0 volumes which dilutes to 2.5 volumes in the finished drink.

In commercial and factory soft-drink cooling, carbonation and dispensing systems, these physical constraints imposed by water, syrup, pressure and temperature are met with concentrated and relatively expensive hardware which bring horsepower, high pressure, booster pumps, large heat exchangers and other special and relatively expensive hardware to bear upon these problems. The constraints are solved with costly componentry.

What we have been trying to do for several decades is to devise a low-cost, reliable, simple, relatively uncomplicated method and apparatus for cooling, carbonating and dispensing soft drinks, the kind of method and apparature that can be used in a home, or a professional office, or for weekend parties.

One such recent attempt is that of John R. McMillin as is shown and taught in his co-pending patent application U.S. Ser. No. 453,183 filed on Dec. 27, 1982. This particular system has a miniature refrigerator cabinet with a 30 watt 0.04 HP) electro-mechanical compressor. This is the smallest compressor available in the world as of this date. Within a cooling compartment is an evaporator which cools air in the cooling chamber. Within the cooling chamber are three syrup reservoirs, each of which holds about ½ gallon (1.9L) of soft drink syrup. Also within the cooling chamber is a combination water reservoir and carbonator. The reservoir is closed and pressurized with carbon dioxide gas and sized to hold about 5 gallons (18.9L) of water. The reservoir has a float and needle valve fill control connected to a water supply line. An outlet from the reservoir goes to a dispensing nozzle.

The carbonation pressure upon the reservoir and the water therein is at 25 PSIG (1.76 kg/sq cm) constant and the thermostat is pre-set to maintain the water at about 35 degrees F. (1.7 degrees C.). When this system is initially filled with water and syrup, it takes about 72 hours for the water and syrup to be cooled and carbonated to produce a drink at 36 degrees F. (2.2 degrees C.). This system produces an excellent finished beverage with a reliable 3.5 volume of carbonation and 36 degrees F. (2.2 degrees C.) temperature.

The problem is lack of dispensing capacity. As drinks are dispensed, cold carbonated water is drawn out of the reservoir and is replaced by relatively warm non-carbonated water which needs to be cooled and carbonated. The refilling rate is far in excess of the cooling capacity of the refrigeration system and the water in the reservoir increases in temperature and decreases in carbonation until the system can no longer dispense a satisfactory drink. As this machine was embodied, it could dispense up to twenty 6 oz. (177 ml) drinks before the carbonated water became too warm and the carbonation became too low. Specifically, dispensing of 3540 ml of beverage withdraws 2950 ml of water from the reservoir. After replacement of the 2950 ml of cold carbonated water with warm non-carbonated water, the water in the reservoir warms up to 41.2 degrees F. (5.1 degrees C.) and has at the most 3.8 volumes of carbonation. The dispensed drink will be at 40.2 degrees F. (4.6 degrees C.) or higher and have 3.2 or less volumes of carbonation. When ice is placed in the drink, the temperature will go down, but the flavor and carbonation both become diluted.

One method that has been utilized to increase the dispensing capacity of this unit is to shut off the water inlet. Then you can dispense the entire contents without dilution, warm-up and carbonation loss. The problem with this is that it is a nuisance and the refrigeration capacity, during the period in which the water is shut off, is lost. After dispensing, when the water line is then turned back on, the refrigeration starts itself. The dispenser will have to recover itself during the night and on following days.

It can be seen that this system works and dispenses well, but it does not have sufficient dispensing capacity to enable it to utilize and dispense its cooled and carbonated contents.

OBJECTS OF THE INVENTION

It is an object of the present invention to provide a cold beverage dispenser of low cost and minimal complexity that has a substantial dispensing capability.

It is an object of the present invention to provide a cold beverage dispenser of low power that can dispense the entirety of a large inventory while refilling itself, and without dispensing warm beverage.

It is an object of the present invention to provide a cold beverage apparatus having an improved water system for cooling, carbonating and dispensing water.

It is an object of the present invention to provide a cold beverage dispenser having a reservoir and a precooler in a common cold air cooling chamber.

It is an object of the present invention to provide a cold beverage dispenser in a cold air refrigerator cabinet, with a relatively large dispensing capacity.

It is an object of the present invention to provide a device for precooling beverage in a cold air refrigerator type beverage dispenser so that the contents of a downstream reservoir can be completely dispensed.

It is an object of the present invention to provide a kit that can be retrofitted and substantially increase the dispensing capacity of a cold drink dispenser.

It is an object of the present invention to provide a new method of cooling and dispensing cold beverage.

It is an object of the present invention to provide a new method of cooling, carbonating and dispensing in a cold-air cooler with minimal power yet with relatively high capacity and simplicity.

These and other objects of the invention will become manifest to those versed in the art upon reference to and study of the teachings herein.

SUMMARY OF THE INVENTION

According to the principles of the present invention, a beverage cooling and dispensing apparatus has a cabinet with a cold air cooling chamber, a beverage reservoir in the chamber, an outlet from the reservoir to a dispensing valve, and a thermally conductive precooler in the cold air chamber, the precooler has a substantial restriction to flow therethrough.

A beverage precooler for a beverage cooling and dispensing machine has an elongate length of tubing having a restrictive inner passageway, an exterior surface area at least a magnitude greater than the passageway volume, and structure on each end for connection to an inlet and an outlet line respectively.

A beverage precooler kit for a beverage cooling and dispensing apparatus has a thermally conductive beverage precooler having an inlet, outlet, a passageway having substantial restriction to beverage flow therethrough, and an external surface area of at least a magnitude greater than the volume of the passageway; and a beverage pressure regulator installable on the upstream end of the inlet to effect a constant pressure upon the inlet.

A method of cooling and dispensing cold beverage has the steps of storing a supply of previously precooled beverage in a storage reservoir, dispensing servings of cold beverage from the reservoir, replenishing the reservoir supply with new beverage at an incoming flow rate substantially less than the dispensing flow rate by restricting the incoming flow to a trickle and running the trickle flow through a precooler, while cooling both the reservoir and the precooler and the beverage therein.

BRIEF DESCRIPTION OF THE DRAWINGS

FIG. 8 is a detail view of part of the apparatus of FIG. 6;

FIG. 9 is a detail view of the structure of FIG. 8 shown collapsed;

FIG. 10 is a graph showing relative heat exchange capacity; and

FIG. 11 is a graph showing relative absorption of cooling capacity.

DESCRIPTION OF THE PREFERRED EMBODIMENTS

Figure 1:
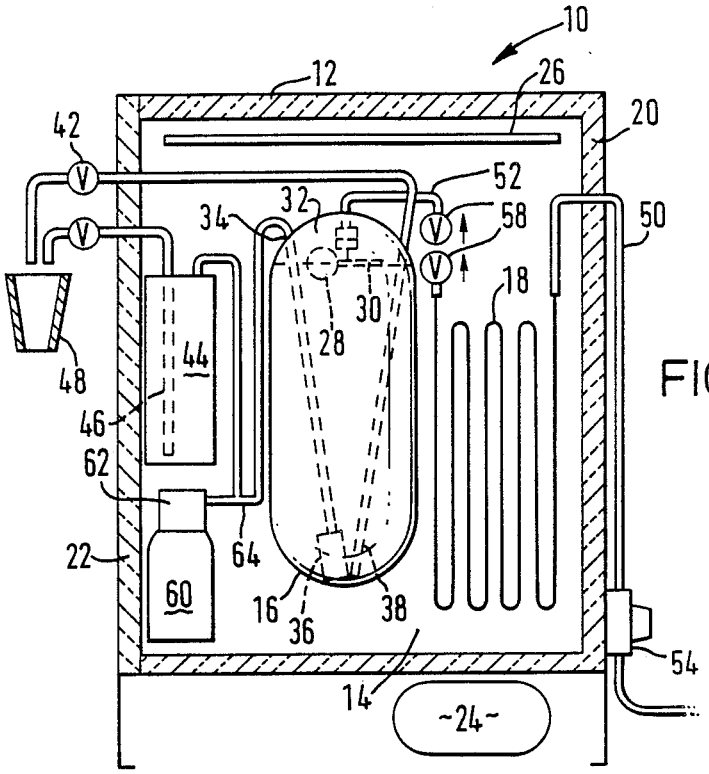
FIG. 1 is a elevational view of a schematic of the apparatus of the present invention and of apparatus with which the method of the present invention may be practiced.

According to the principles of the present invention a beverage cooling and dispensing apparatus, as schematically shown in FIG. 1 and generally indicated by the numeral 10 and hereinafter referred to as the dispenser 10, has a refrigerator 12 having a cold air cooling chamber 14 within which is a cold beverage reservoir 16 and a beverage precooler 18 which restricts flow into the reservoir 16 and precools the flow before it is admitted to the reservoir 16.

The refrigerator 12 has a cabinet 20 and an openable door 22 which define and enclose the cooling chamber 14. Outside of the chamber 14 is a compressor 24 and inside of the chamber is a cooling evaporator 26 which is connected to the compressor 24 in a conventional manner. The compressor 24 is as small as possible; the preferred compressor 24 is a 30 watt (0.04 HP) output miniature compressor manufactured by Sanyo Electric of Japan. The refrigerator 12 could be any domestic type refrigerator that has a cooled cold air chamber without specific provision for direct heat transfer to cool beverage via a coil immersed in an ice water bath, a eutectic tank or other intimate contact structure. The refrigerator 12 regardless of type has an evaporator 26 that cools the air in the chamber 14, and the cold air cools the reservoir 16 and the precooler 18. While the preferred refrigerator 12 has convective flow of cooled air, forced cold air flow as seen in domestic refrigerators is an alternative.

The beverage reservoir 16 holds several discrete servings of beverage. For example, a preferred capacity of the reservoir 16 is 5 gallons (18.9L). A 10 ounce (296 ml) post-mix drink takes 8 ounces (237 ml) of water and the reservoir 16 will store cold water sufficient for the draw of about eighty of these drinks or for one hundred twenty eight smaller 6 ounce (177 ml) drinks. The reservoir 16 has a float and valve fill control 28 which automatically controls the maximum water level 30 so that there is always a head space 32 for a gas head on top of the water. The reservoir 16 has a carbon dioxide inlet 34 with a porous diffuser element 36 in the bottom of the reservoir 16. A syphon tube 38 extends from the bottom of the reservoir 16 to a beverage outlet line 40 which extends to a dispensing valve 42.

A syrup container 44 is mounted on the inside of the door 22 and in the cooling chamber 14. A syrup line 46 leads to a dispensing nozzle 48. The dispensing componentry is more fully described in J. R. McMillin U.S. Ser. No. 453,183 filed on Dec. 27, 1982.

An important feature of this invention is the precooler 18 which is in the cold air cooling chamber 14 and upstream of the reservoir 16. A plastic supply line 50 leads from the outside and preferably from a municipal or potable water supply to the precooler 18, and a plastic inlet line 52 connects the precooler 18 to the reservoir 16 via the fill control 28. If the supply line 50 is connected to a municipal water supply where the pressure frequently fluctuates and is unpredictable, a water pressure regulator 54 is installed in the supply line 50 and on the outside of the refrigerator 12. The regulator 54 is pre-set to a constant outlet pressure in the range of 35–45 PSIG (2.46–3.16 kg/sq cm) and a preferred pressure is 40 PSIG (2.8 kg/sq cm). Each end of the precooler 18 has a fitting 56 for being connected to the supply line 50 or the inlet line 50. The inlet line 50 has a double check valve 58 for allowing flow from the precooler 18 to the reservoir 16 and for precluding backward flow from the reservoir 16 to the precooler 18.

A small compressed gas cylinder 60 and pressure regulator 62 for carbon dioxide gas are inside the cooling chamber 14. A gas line 64 connects the regulator 62 to the reservoir 16 and to the syrup container 44. The gas regulator 62 is pre-set to give a constant output pressure of 25 PSIG (1.76 kg/sq cm) which is less than the output pressure of the water regulator 54 by 15 PSIG (1.05 kg/sq cm).

There are two preferable structural embodiments utilizing the precooler 18. In both of these embodiments the refrigerator 12, reservoir 16 and other components are essentially identical unless otherwise described.

Figure 3:
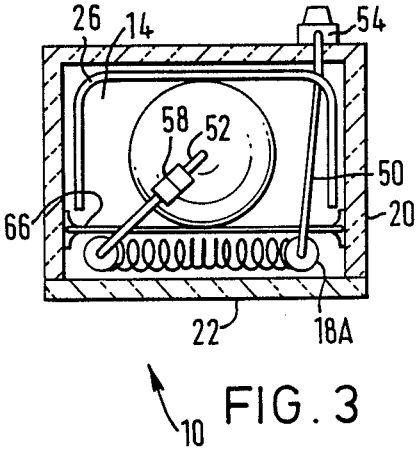
FIG. 3 is a top plan view, in section, of the apparatus of FIG. 2.
Figure 2:
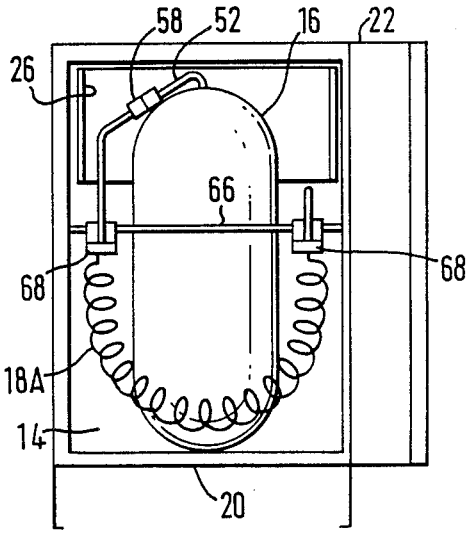
FIG. 2 is a elevational front view, with the door open, of the preferred structural embodiment of the apparatus of the present invention.
Figure 4:
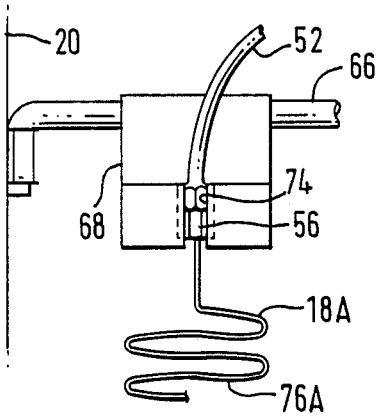
FIG. 4 is front elevational detail view of part of the apparatus of FIG. 2.
Figure 5:
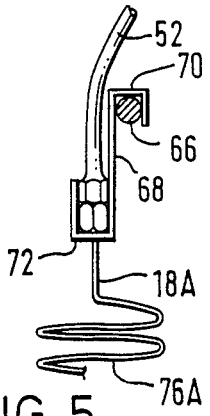
FIG. 5 is a side plan view of the structure of FIG. 4.
Figure 7:
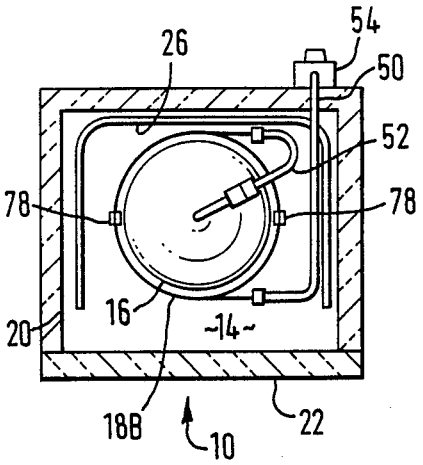
FIG. 7 is a top plan view, in section, of the apparatus of FIG. 6.
Figure 6:
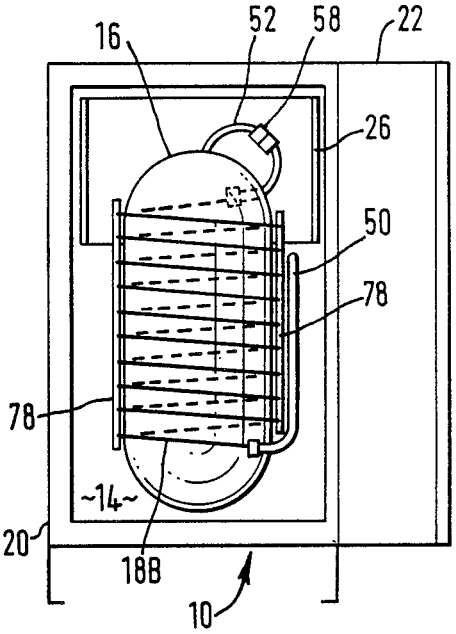
FIG. 6 is a front elevational view, with the door open, of an alternative referred structural embodiment of the apparatus of the present invention.

FIGS. 2–5 illustrate a first preferred structural embodiment in which the precooler 18A is wound into a relatively small diameter helical coil spring which is suspended by its ends in a general U-shape. In front of the reservoir 16 is a transverse reservoir retainer bar 66. A pair of S-shaped hanger clips 68 each have an upper end 70 over the bar 66, and lower end 72 under a precooler fitting 56. Each lower end 72 has a slot 74 for receiving the precooler 18. The precooler 18A is wound closed but when hanging as seen in FIGS. 2 & 3, each individual coil 76A is spread from each adjacent coil 76A and cold air moves freely over and between each coil 76A.

FIGS. 6–9 illustrate the second preferred structural embodiment in which the precooler 18B is around the reservoir 16 in a relatively large discrete helical spring. Again the coils 76B are wound closed but installed spread from each other and spaced from the reservoir 16. The spread precooler 18B has at least two coil racks 78, each of which has an inner plate 80 and an outer plate 82. The plates have a corrugation that loosely receives the coils 76B and which keeps the coils 76B spread from each other. The plates 80, 82 are fastened together by spot welding or wire ties. The second precooler 18B folds up for inventory and shipping as is seen in FIG. 9 with the racks 78 and coils 76B nested against each other side-by-side. Both precoolers 18A, 18B are positioned underneath the evaporator 26 so that cold air off the evaporator 26 connectively drafts down, over and through the precoolers 18A, 18B.

Each precooler 18A, 18B embodiment has its advantages and disadvantages. Both precoolers 18A, 18B have the same thermal exchange capacity and the costs are comparable. The first precooler 18A lends itself to retro-fit and to installation as an optional accessory. The disadvantage is its physical vulnerability. The second precooler 18B is very well protected and takes less volume in the chamber 14 and is ideally suited when all units of the dispenser 10 are to be built with the precooler 18B. The disadvantage is that precooler 18B requires removal of the reservoir 16 from the refrigerator 12 for installation, therefore retro-fit and line item assembly are not easily done.

The first precooler 18A is ideally suited for a retro-fit or line item assembly kit wherein the precooler 18A, regulator 54, hanger clips 68 and various tubing and fittings are packaged as a kit either discretely or with the balance of the componentry such as the reservoir 16 if a complete dispenser kit is desired.

The precooler 18 per se, whether embodied in the first version 18A or the second version 18B, is an elongate length of thermally conductive tubing that has a significant, high and precise, restriction to the flow of liquid therethrough. The preferred tubing is copper refrigeration capillary tubing. A specific preferred capillary tubing is hard drawn copper tube having a 0.042 inch (1.07 mm) inside diameter passageway, a 0.094 inch (2.4 mm) outside diameter, and a length of fifty feet (15.24 meters). This preferred precooler 18 has an internal area of 79.2 square inches (511 sq cm), an internal volume of 0.831 cubic inches (13.6 cc) and an external area of 177.0 sq. inches (1142 sq cm). With this preferred precooler 18, and with the water pressure regulator 54 set at 40 PSIG (2.8 kg/sq cm) and with the carbon dioxide pressure regulator 62 set at 25 PSIG (1.76 kg/sq cm) which gives a 15 PSIG (1.05 kg/sq cm) pressure differential, the flow rate of water through the precooler 18 and therefore the fill rate of water into the reservoir 16 is about 10 ounces (296 cc) per hour. This flow rate is a mere trickle, and is about 1.7 drops of water per second. Each molecule of water is in the precooler 18 about 2 minutes and 45 seconds during flow through the precooler 18. The precooler 18 has a length to outside diameter (L:OD) ratio of at least 1000:1, of at least 5000:1, and the preferred structure has a ratio of 6350:1. The ratio of the length of the inside diameter (L:ID) is significantly greater and is at least 10,000:1 with the preferred ratio being in a range between 14,000 and 15,000:1. The precooler 18 presents an external area to the cold air that is over twice the internal area in contact with the water. The external area of the precooler 18 is at least 200 times the volume of the internal passageway measured in inches. The specific preferred ratio is 213:1 of square inches to cubic inches, and 84:1 square centimeters to cubic centimeters. The mass of the precooler 18 is significantly greater than the mass of the water it will hold. Specifically a preferred precooler 18 is 476.05 grams and holds 13.6 grams of water for a 35:1 rato of precooler 18 mass to internal water mass.

The reservoir 16 by contrast has a preferred structural size of 9 inch diameter by about 20 inches high (22.86 cm by 50.8 cm) and is of thin section stainless steel. Both the inner and outer area of the reservoir 16 are about 690 square inches for an effective water volume of 1155 cubic inches (4450 sq cm for 18,930 cc) which gives an area to volume ratio for the reservoir 16 of 0.6:1 in inches or 0.24:1 in metric measurement; regardless of whether measured in inches or metrically, the area to volume ratio is substantially less than one and substantially less than the equivalent ratios for the precooler 18.

The precooler 18 has an area to volume ratio which is at least one hundred times and preferably in the range of two hundred to four hundred times the equivalent ratio of the area to volume of the reservoir 16. A specific preferred ratio between the area to volume ratios of the precooler 18 and reservoir 16 is 350:1.

For example:

Measured in inches:

$$\frac{177.0 \text{ sq.in.}}{0.831 \text{ cu.in.}} : \frac{690 \text{ sq.in.}}{1155 \text{ cu.in.}} = 212:0.6 = 353:1$$

Measured in centimeters:

$$\frac{1142 \text{ sq.cm.}}{13.6 \text{ cc}} : \frac{4430 \text{ sq.cm.}}{18930 \text{ cc}} = 839:0.24 = 350:1$$

The precooler 18 has a heat exchange capacity that at least approaches the heat exchange capacity of the reservoir 16, and it is preferable for the precooler 18 to have a heat exchange capacity greater than the reservoir 16. The precooler 18 may be serpentine (18), small helical coil (18A), big helical coil (18B) fin and tube, a flat plate device, or a radiator device having high heat exchange capacity. When the dispenser 10 has its reservoir 16 filled and the dispenser is not being utilized for dispensing, the majority of the cooling load is taken by the water in the reservoir 16 which was admitted into the reservoir 16 at about 40 degrees F. (4.4 degrees C.) and which is subsequently deep cooled down to about 35 degrees F. (1.7 degrees C.); this is as cold as the water can be reliably cooled without freezing problems During the period when the reservoir 16 is filled and no dispensing is taking place, the precooler stabilizes at 35 degrees F. (1.7 degrees C.) and no cooling load is taken by the precooler 18. The water in the reservoir 16 takes all of the available cooling capacity and deep cools from the acceptable 40 degrees F. (4.4 degrees C.) to the preferred 35 degrees F. (1.7 degrees C.).

During dispensing, the precooler 18 can and does consume most of the cooling capacity because the precooler 18 then has a heat exchange capacity greater than the reservoir 16. During dispensing the relative heat exchange capacity of the reservoir 16 decreases as the precooler 18 heat exchange remains constant. The absolute amount of units of heat exchange are not accurately known but the ratios can be approximated.

For example:

(1) When there is no replenishing flow into the reservoir 16, there is no flow through the precooler 18. The precooler 18 and the water therein deep cool to about 35 degrees F. (1.7 degrees C.). The precooler 18 then presents no load to the cooling system and has no further heat exchange capability.

(2) When the reservoir 16 is being replenished, the flow of water into the precooler will have an inlet temperature of about 75 degrees F. (23.9 degrees C.) and an outlet temperature of 40 degrees F. (4.4 degrees C.). The heat exchange capability and relative ability to absorb cooling capacity can be expressed as (precooler area presented to the cold air)×(average temperature differential of the water, above the cold air normally at 0 degrees C.)

$$(1143 \text{ in cm}) \frac{(23.9 \text{ C.} + 4.4 \text{ C.})}{2} = 16{,}173 \text{ units}$$

(3) The reservoir 16 presents a variable heat exchange load in the cooling chamber 14. As the water level decreases, the cooling load decreases. An approximation of these loads, on a relative scale:

| Reservoir Water Level | Area of Side & Bottom Presented | × | Average T Above Cold Air Temp. | = | Exchange Units |
|---|---|---|---|---|---|
| Full | 3335 sq cm | | 3.06° C. | | 10,200 |
| ¾ | 2605 sq cm | | 3.06° C. | | 8,000 |
| ½ | 1870 sq cm | | 3.06° C. | | 5,700 |
| ¼ | 1140 sq cm | | 3.06° C. | | 3,500 |
| 1 serving | 260 sq cm | | 4.4° C. | | 1,140 |
| Empty | 0 | | 0 | | 0 |

FIG. 10 is an attempt to illustrate the relative heat exchange capacity of the precooler 18 and reservoir 16. When water is flowing through the precooler 18 its capacity is maximum, and when flow stops its capacity decreases to zero. The reservoir 16 capacity decreases as the water level decreases because the area of the bottom and cylindrical side decreases. This graph is approximate only and it is suspected but not ascertained that the reservoir 16 curve lies substantially lower because there is no agitator mechanism in the reservoir 16 and convection and $CO_2$ bubbles entering the reservoir 16 are relied upon to move the water and even out the temperatures in the water within the reservoir 16.

FIG. 11 illustrates the absorption of 100% of the available and utilized cooling capacity firstly as taken in part by the precooler 18 shown below the solid line, and secondly as taken in part by the reservoir 16 shown above the line. It can be seen that when the dispenser 10 has been sitting unused and the reservoir 16 is filled and there is no flow in the precooler 18, that virtually all of the cooling is absorbed by the reservoir 16 during deep cooling of the reservoir water from 40 degrees F. (4.4 degrees C.) to 35 degrees F. (1.7 degrees C.) or lower. As dispensing is started, the fill control 28 opens and water flows through the precooler 18. The precooler 18 immediately takes the majority of the cooling available. As cold water is withdrawn from the reservoir 16, the reservoir 16 takes less and less of the cooling and the precooler 18 takes more until when the reservoir 16 is temporarily empty, the precooler 18 takes all of the cooling. The exact location of the line between full and empty in FIG. 11 is not precisely known and it is suspected to be substantially higher and closer to the alternative dotted line, again due to absence of forced water circulation in the water reservoir 16.

During operation of the dispenser 10 and in the practice of the method of the present invention, the refrigeration compressor 24 is turned on, the syrup container 44 or containers as the case may be, has syrup placed in it, and the supply line 50 is connected to a source of water. if the water pressure is high or fluctuating, the regulator 54 applies only the predetermined and preset 40 PSIG (2.81 kgs/sq cm) on the precooler 18. The water flow through the precooler 18 is restricted to a trickle flow of about 10 ounces (296 cc) per hour which is about 1.7 drops per second. This trickle flow is cooled from an anticipated 75 degrees F. (23.9 degrees C.) to 40 degrees F. (4.4 degrees C.) and then admitted to the reservoir 16. The reservoir 16 is pressurized with carbon dioxide gas at 25 PSIG (1.76 kgs/sq cm) which then carbonates the precooled water to about 3.9 volumes of carbonation. Over a period of about 60–72 hours the reservoir 16 will fill and the water and syrup will all be cooled to below 40 degrees F. (4.4 degrees C.). This takes an extended period of time because the compressor has only a 30 watt (0.04 HP) output. This period is called initial pull down.

After pull down, the dispenser 10 is ready for dispensing with the water and syrup at close to 35 degrees F. (1.7 degrees C.) after deep cooling. The carbonation of the water will gradually increase to about 4.4 volumes.

When dispensing is done, the standard dispensing flow rate is in the range of 1.5–3.0 ounces (44.4–88.7 cc) per second. Part of the flow is syrup and part is water. The water portion is usually 5/6 of the total flow so the water dispensing flow rate is typically in the range of 1.25–2.5 ounces (40.0–73.9 cc) per second. This water dispensing rate is substantially greater than the flow rate through the precooler 18, specifically at the lowest dispensing rate of 40 cc per second and with the flow rate through the precooler 18 being 0.082 cc/second, it is about 487 times the precooler 18 flow rate. As soon as the dispensing starts, the fill control 28 re-opens and replenishing of the dispensed water begins. The gas head propels out the water to be dispensed, and new water begins to flow in the precooler 18. The high thermal mass of the precooler 18 effectively cools the first couple of minutes flow and then heat exchange from water to precooler 18 and then to cold air in the chamber 14 begins. The small compressor 24 can easily keep up to the restricted flow through the precooler 18. The restricted flow or trickle is at least a magnitude (10×) less and preferably two magnitudes less (100×) than the dispensing flow. The preferred trickle flow is in the range of 1/400 to 1/500th of the dispensing flow rate. The trickle flow is always cooled to less than 40 degrees F. (4.4 degrees C.) which is the maximum acceptable dispensing temperature. The reservoir 16 and precooler 18 are commonly cooled with a convective air flow off of the evaporator 26.

This dispenser 10 and the method herein described, enable the building of a very large reserve of individual servings, for example eighty—10 ounce (296 cc) drinks over an extended period of time. This entire built up inventory can be dispensed without warm up and while the refrigeration is on and rebuilding.

For example, in a home where a party is hosted on a weekend, the dispenser 10 can take Wednesday, Thursday and Friday to build up its inventory of cold beverage. On Saturday dispensing is started and the compressor 24 turns on and the dispenser 10 begins replenishing at 10 ounces (296 cc) per hour. Over an eight hour party the capacity of the reservoir 16 and the replenishing flow of 80 ounces (2960 cc) can be dispensed. If the reservoir 16 is the previously referred to 18.93 liters, the total cooled and carbonated water available is 21.9 liters which is then mixed with 4.4 liters of syrup to give 26.3 liters of finished post mixed soft drinks. This is 89 servings at 10 ounces (296 cc) or 148 servings at 6 ounces (177 cc). if the party extends until Sunday evening the dispenser 10 can replenish for 32 hours, and provide an additional 320 ounces of 9460 cc of cold carbonated water to provide 34.1 liters of soft drink which is 115 large drinks or 193 small drinks before the reservoir 16 goes empty. The dispenser 10 then replenishes itself from Sunday night until Wednesday.

During refill after the reservoir 16 has been emptied, and during the initial filling of the dispenser 10, the just filled contents of the reservoir 16, be it one serving, a ¼ full, ½ full, ¾ full or just short of full, are cold carbonated water at or below 40 degrees F. (4.4 degrees C.) ready to be dispensed and consumed. The reservoir 16 never contains water which is too warm.

This same dispenser 10 and method lends itself to professional offices, cabins, and any other site where the dispenser 10 can replenish itself all night, for several days or over a weekend and prepare itself for a period of high dispensing that exceeds its refrigeration capacity.

This dispenser 10 and method is ideally suited for placement within a domestic refrigerator, having forced air circulation or convection. Forced air circulation will increase the total cooling and dispensing capacity and enable the usage of a larger and more expensive compressor. The size and cost of the precooler 18 and reservoir 16 may also be reduced with forced circulation of cooled air.

The kit having the precooler 18 is ideally suited for upgrading older beverage dispensing devices.

Although other advantages may be found and realized and various and minor modifications may be suggested by those versed in the art, be it understood that I wish to embody within the scope of the patent warranted hereon, all such improvements as reasonably and properly come within the scope of my contribution to the art.

I claim:

1. A beverage cooling and dispensing apparatus for cooling and dispensing a potable liquid, the apparatus comprising:

a refrigerator having a cabinet, a cold air cooling chamber in the cabinet, and a refrigeration evaporator for cooling the air chamber, a reservoir in the cooling chamber separate from the evaporator for retaining a volume of the potable liquid, a dispensing valve fluidly connected to an outlet of the reservoir for dispensing the potable liquid from the reservoir, a thermally conducting pre-cooling tube, the precooling tube suspended within the air chamber and separate from and cooled by the evaporator, and the tube connected on one end to an inlet of the reservoir and on an opposite end thereof to a pressurized source of potable liquid for providing a flow of the liquid therethrough from the liquid source to the reservoir, the tube having an exterior surface area and an interior volume, and the tube having a length, a ratio of the exterior surface area to the interior volume and an inside diameter particularly selected for providing both a heat exchanging ability and a restricting of the flow of liquid therethrough so that all the liquid delivered by the tube to the reservoir reaches the reservoir at a temperature substantially equal to the temperature of the air chamber and where the tube solely provides for the restricting of the liquid flow from the source thereof to the reservoir.

2. The apparatus as defined in claim 1, and further including a pressure regulating valve between the pressurized liquid source and the pre-cooling tube so that the liquid is supplied to the pre-cooling tube at a particular pressure.

3. The apparatus as defined in claim 1, wherein the tube is helically coiled having a plurality of individual coils and suspended with the air chamber by securing each end thereof at a substantially equal level within the air chamber, and the helically coiled tube being flexible so that it forms a u-shape under the force of gravity when so suspended where the coils thereof are substantially separate from each other.

4. The apparatus as defined in claim 1, wherein the pre-cooling tube is wound around the reservoir forming a plurality of coils, with each coil being spaced outwardly from the reservoir and away from an adjacent coil, and including a coil rack on opposed sides of the reservoir for securing the tube to the reservoir and for maintaining the spacing from the reservoir and between the individual coils.

5. The apparatus as defined in claim 1, and the pre-cooling tube helically coiled forming a plurality of individual helical coils and further including coil racks secured to the helical coils and the coil racks collapsible upon each other for flattening the coils against each other.

6. An apparatus for use in beverage cooling and dispensing equipment, the equipment for cooling and dispensing a potable liquid and having a refrigerator with a cabinet, a cold air cooling chamber in the cabinet, a refrigeration evaporator for cooling the air chamber, a reservoir in the cooling chamber separate from the evaporator for retaining a volume of the potable liquid, and a dispensing valve fluidly connected to an outlet of the reservoir for dispensing the potable liquid from the reservoir, the apparatus comprising:

a thermally conducting pre-cooling tube, the pre-cooling tube suspended within the air chamber and separate from and cooled by the evaporator, and the tube connected on one end to an inlet of the reservoir and on an opposite end thereof to a pressure regulating valve, and the valve connected to a pressurized source of potable liquid for providing a regulated flow of the liquid at a particular pressure to the pre-cooling tube for delivery of the liquid therethrough from the liquid source to the reservoir, the tube having an exterior surface area and an interior volume, and the tube having a length, a ratio of the exterior surface area to the interior volume and an inside diameter particularly selected for providing both a heat exchanging ability and a restricting of the flow of liquid therethrough so that all the liquid delivered by the tube to the reservoir reaches the reservoir at a temperature substantially equal to the temperature of the air chamber and where the tube solely provides for the restricting of the liquid flow at the particular pressure from the source thereof to the reservoir.

7. The apparatus as defined in claim 6, and further including a pressure regulating valve between the pressurized liquid source and the pre-cooling tube so that the liquid is supplied to the pre-cooling tube at a particular pressure.

8. The apparatus as defined in claim 6, wherein the tube is helically coiled having a plurality of individual coils and suspended with the air chamber by securing each end thereof at a substantially equal level within the air chamber, and the helically coiled tube being flexible so that it forms a u-shape under the force of gravity when so suspended where the coils thereof are substantially separate from each other.

9. The apparatus as defined in claim 6, wherein the pre-cooling tube is wound around the reservoir forming a plurality of coils, with each coil being spaced outwardly from the reservoir and away from an adjacent coil, and including a coil rack on opposed sides of the reservoir for securing the tube to the reservoir and for maintaining the spacing from the reservoir and between the individual coils.

10. The apparatus as defined in claim 6, and the pre-cooling tube helically coiled forming a plurality of individual helical coils and further including coil racks secured to the helical coils and the coil racks collapsible upon each other for flattening the coils against each other.

* * * * *